US010005586B1

(12) United States Patent
Miller

(10) Patent No.: US 10,005,586 B1
(45) Date of Patent: Jun. 26, 2018

(54) DOWEL AND PALLET USING DOWEL

(71) Applicant: Miller Dowel Company, Wilmette, IL (US)

(72) Inventor: Michael R. Miller, Winnetka, IL (US)

(73) Assignee: Miller Dowel Company, Wilmette, IL (US)

( * ) Notice: Subject to any disclaimer, the term of this patent is extended or adjusted under 35 U.S.C. 154(b) by 0 days. days.

(21) Appl. No.: 15/479,931

(22) Filed: Apr. 5, 2017

(51) Int. Cl.
*B65D 19/00* (2006.01)
*B65D 19/38* (2006.01)

(52) U.S. Cl.
CPC ..... *B65D 19/0095* (2013.01); *B65D 19/38* (2013.01); *B65D 2519/00029* (2013.01); *B65D 2519/00064* (2013.01); *B65D 2519/00099* (2013.01); *B65D 2519/00273* (2013.01); *B65D 2519/00293* (2013.01); *B65D 2519/00323* (2013.01); *B65D 2519/00373* (2013.01); *B65D 2519/00572* (2013.01)

(58) Field of Classification Search
CPC ..... B65D 19/38; B65D 2519/00572; B65D 2519/00099; B65D 2519/00064; B65D 2519/00029
USPC ..... 108/51.11, 51.3
See application file for complete search history.

(56) References Cited

U.S. PATENT DOCUMENTS 100,055 A 2/1870 Montgomery
332,308 A 12/1885 Valentine
569,235 A 10/1896 Rockwell
876,985 A 1/1908 Malacon
RE13,915 E 5/1915 Evans
1,229,565 A 6/1917 Ahlgren
2,621,006 A 7/1948 Norrefeldt et al.
2,667,795 A 2/1954 Bowen
2,817,620 A 12/1957 Golick et al.
3,016,222 A 1/1962 Arthur
3,104,430 A 9/1963 Badali
3,153,283 A 10/1964 Weissman
3,204,583 A 9/1965 Nicholson
3,207,096 A * 9/1965 Munroe ..... B65D 19/0091 108/51.11
3,221,458 A 12/1965 Lucas
3,498,171 A * 3/1970 Jureit ..... F16L 315/0046 411/466
3,527,486 A 9/1970 Camp
3,575,520 A 4/1971 Halpern
3,635,573 A 1/1972 Halpern
3,756,635 A 9/1973 Beers
3,850,054 A 11/1974 Weissman
3,883,258 A 5/1975 Hewson
(Continued)

*Primary Examiner* — Jose V Chen
(74) *Attorney, Agent, or Firm* — Husch Blackwell LLP

(57) ABSTRACT

An improved pallet that is easy to assemble and disassemble. In particular, the pallet includes a plurality of stringers with bores, a plurality of deck boards with openings, and a plurality of dowels that attach the stringers and boards at an acute angle. The dowels can have protruding portions for aligning with dimples in the bottoms of neighboring pallets, thus vertically orienting stacked pallets with respect to each other, for efficient and secure stacking of the pallets. The protruding portions can be configured so as to deflect random blows and to minimize damage to the pallets when stacked. The dowels can also be positioned so as to reduce the likelihood of stress fractures to the pallets when the pallets sustain potentially damaging forces.

26 Claims, 6 Drawing Sheets

(56) References Cited

U.S. PATENT DOCUMENTS 3,926,321 A * 12/1975 Trebilcock ..... B65D 71/70 108/53.1
4,128,356 A 12/1978 Carlisle
4,137,115 A 1/1979 Lambert
4,184,435 A * 1/1980 Shevchenko ..... B65D 19/0069 108/57.1
4,291,996 A * 9/1981 Gilb ..... E04B 1/2612 403/14
4,340,327 A 7/1982 Martins
4,398,653 A * 8/1983 Daloisio ..... B65D 90/205 108/53.1
4,424,753 A 1/1984 Eatherton
4,480,941 A * 11/1984 Gilb ..... E04B 1/2612 248/216.1
4,518,291 A 5/1985 Lang et al.
4,536,044 A 8/1985 Ziegelheim et al.
4,638,971 A * 1/1987 Basinsky ..... F16M 5/00 108/55.1
4,639,197 A 1/1987 Tonare et al.
4,793,745 A 12/1988 Ashbaugh et al.
4,815,902 A 3/1989 Durfee, Jr.
4,884,571 A 12/1989 Baker
5,071,280 A * 12/1991 Turner ..... E04B 1/2612 403/232.1
5,100,162 A 3/1992 Lo
5,131,783 A 7/1992 Astl
5,232,302 A 8/1993 Wagner et al.
5,265,988 A 11/1993 Schmigalla et al.
5,326,196 A 7/1994 Noll
5,333,555 A 8/1994 McPhee
5,419,649 A * 5/1995 Gilb ..... E04B 1/2608 403/231
5,458,069 A 10/1995 Stolzman
5,529,424 A 6/1996 Neubert et al.
D371,302 S 7/1996 Spirer
5,584,951 A 12/1996 MacFarland
5,673,629 A * 10/1997 Ginnow ..... B65D 19/0095 108/56.1
5,685,234 A 11/1997 Grigsby et al.
5,768,845 A 6/1998 Beaulieu et al.
5,771,650 A 6/1998 Williams et al.
5,807,015 A 9/1998 Goto
5,960,721 A 10/1999 Huetteman et al.
5,967,056 A 10/1999 Plante
D426,766 S 6/2000 Burchall et al.
6,267,527 B1 7/2001 Miller
D456,700 S 5/2002 Miller et al.
6,578,341 B2 * 6/2003 Hoffmann ..... E04B 1/2604 403/381
6,584,915 B1 * 7/2003 Rogers ..... B65D 19/0095 108/51.11
D484,781 S 1/2004 Miller
6,814,287 B1 11/2004 Chang et al.
6,871,681 B2 3/2005 Miller
7,762,031 B2 * 7/2010 Leek ..... E04B 1/2608 249/93
7,856,933 B2 * 12/2010 Miller ..... B65D 19/0095 108/51.11
8,627,773 B2 * 1/2014 Storteboom ..... B65D 19/38 108/51.11
8,850,993 B2 * 10/2014 Storteboom ..... B65D 19/0093 108/51.11
9,038,546 B2 * 5/2015 Ten Bok ..... B65D 19/0048 108/57.17
2003/0089771 A1 5/2003 Cybulski et al.
2004/0099339 A1 5/2004 Miller
2005/0072700 A1 * 4/2005 Sutt, Jr. ..... B65D 19/38 206/338
2006/0005746 A1 * 1/2006 Gouldin, Jr. ..... B65D 19/0091 108/51.11
2006/0054064 A1 3/2006 Miller et al.
2008/0115699 A1 5/2008 Miller et al.
2008/0156234 A1 * 7/2008 van de Camp .... B65D 19/0095 108/51.11
2009/0255605 A1 10/2009 Filion et al.
2010/0300332 A1 * 12/2010 Hayman ..... B65D 19/38 108/51.11
2015/0210425 A1 * 7/2015 Miller ..... B65D 19/0095 108/57.17

* cited by examiner

DOWEL AND PALLET USING DOWEL

BACKGROUND OF THE INVENTION

Pallets of various types are known in the art. Pallets are typically constructed with parallel stringers to which transverse deck boards are then nailed or otherwise secured to form the pallet. Pallets need to have sufficient strength to bear the weight of objects loaded thereon, including other pallets, and to withstand such impact forces to which the pallets are subjected when objects are loaded onto and off of them and when the pallets are moved, as by a fork-lift truck or the like. Pallets must also withstand other external forces from their environment.

Typical pallets are constructed of wooden stringers and deck boards which are attached with nails or other metal fastener devices.

Many pallets sustain damage at their lead boards. As a fork lift or other mechanism engages a pallet, the mechanism will often impact the lead board of the pallet, sometimes with significant force. This shearing force may disengage the lead board or otherwise damage it, leaving a worn or weakened pallet with a lessened carrying capacity. Such damaged pallets are at greater risk of failure and greater risk of damage to merchandise and individuals.

Nails or other metal fastener devices are often used to construct pallets, but pallets can be damaged at the locations where the metal fastener devices attach to the wooden parts of the pallets. Such metal fasteners can gouge the wooden portions or create stress fractures in them. These conditions may weaken the pallets, promote their deterioration, and render them inoperable or dangerous to use.

Some fasteners protrude from the wooden boards, either by design or by accident. Where such fasteners protrude, those protrusions may be subjected to impact force from fork lifts or other devices, or forces from other random contact to the pallet. Such protrusions may also impact neighboring pallets, inflicting impact forces on neighboring pallets in addition to suffering impact forces themselves.

Where such protrusions possess sharp edges, those sharp edges may be particularly prone to suffering or inflicting impact forces. Further, such sharp edges may catch on other objects that contact the pallets, resulting in damage to the fasteners, or causing the fasteners to be loosened or pulled free from the pallets. Similarly, such sharp edges can further gouge neighboring pallets, structures, or individuals.

To save money and resources, worn or damaged pallets are often salvaged, with the undamaged portions used to make recycled pallets and the damaged portions put to other uses, such as fuel or sawdust. The cost and effort required to disassemble worn-out pallets increases when the pallets include metal pieces (i.e., nails or metal supports), as many devices that can be routinely used to break down wooden components cannot be used where there are also metal components. For example, standard saws or similar devices effectively cut through wooden boards, but not metal nails.

The devices that are suitable for disassembling wooden pallets having metal fasteners are often large, expensive, and unwieldy to use. These devices often fail to remove all metal fasteners from the wooden components, requiring additional efforts, as well as increased time and cost, to remove such fasteners before the wooden components can be reused.

Further, recycling efforts may require the segregation of waste materials by type; where the pallets are made of both wooden and metal components, additional time and effort may be required to sort the components before recycling them.

More recently, companies who utilize pallets have turned to Radio Frequency Identification ("RFID") technology to monitor and track pallet location and other information. To use such technology, encoded RFID tags or devices are placed on a pallet. However, there have been problems implementing RFID systems, such as metal components interfering with the transmission of signals between RFID tags and RFID readers. Thus, a pallet free of metal parts (e.g., metal fasteners) is particularly advantageous in facilitating the use of RFID technology in conjunction with pallets and their cargo.

Further, metallic fasteners can damage wooden pallets by causing cracking and damage to the wooden components during construction. This problem is particularly pronounced when drier woods are used in the construction of wooden pallets.

However, the construction of metal-free pallets has been problematic. Pallets that rely on adhesives as the sole connecting means between deck boards and stringers have proven vulnerable to shear forces, random blows, and other forces typically sustained by a pallet during its assembly and use. Such pallets often require external clamps or other devices for configuring and holding the pieces together while the adhesive cures. Further, it takes a great deal of time to configure and make such pallets.

Pallets that incorporate either metal nails or wooden dowels to connect the stringers to the deck boards have also suffered problems. The insertion of such fasteners may exert shear forces on the deck boards and stringers during assembly. Further, protruding fasteners may contain sharp edges that may be susceptible to damage by shear forces, or may be loosened or pulled out, when caught on other external structures. Also, shear forces and other typical forces may introduce or exacerbate shear fractures in the deck boards and stringers.

There exists a need for a pallet that can be readily and economically assembled, can withstand substantial impact and load forces, can be easily disassembled, including with dry wood, and will not interfere with RF signals or prevent RFID readers from operating properly.

SUMMARY OF THE INVENTION

The present invention relates generally to combination of deck boards, stringers, and blocks, connected by dowels placed at an acute angle through the other components and/or adhesive, to form a pallet or half pallet. The invention particularly relates to half pallets including round-topped dowels that protrude from the upper surface to engage indentations or depressions on the bottom of another half pallet when the half pallets are stacked, the alignment between the protruding dowels and the depressions providing vertical orientation and stabilization to the stacked half pallets.

The present invention also relates generally to improved dowels having peripheral surfaces with graduated diameters and smooth-surfaced base portions, and pallets incorporating those dowels in configurations that improve the durability and stability of the pallets. The invention also related to pallets made of deck boards, stringers, and the improved dowels.

The invention particularly relates to pallets and dowels made of similar materials, and even more particularly to pallets and dowels made of wood.

An aspect of this invention relates to a substantially wooden pallet including a plurality of deck boards, each deck board including an outward-facing surface and a plurality of openings, each opening defining a hole extending through the deck board at an acute angle to the outward-facing surface; a plurality of first stringers and second stringers, each stringer including first and second surfaces and a plurality of bores in between the surfaces, each bore in a first stringer for aligning with an opening of a deck board and set in each first stringer at an acute angle $\alpha$ to a vertical axis through the first surface; a plurality of first and second blocks each having first and second block surfaces, each first and second block surface having a plurality of channels set at an acute angle to the block surfaces, the channels being for aligning with a bore of a stringer, the first blocks being positioned at the ends of each stringer of the half pallet, with the second blocks in between; and a plurality of first and second dowels, the dowels having upper and lower portions of decreasing cross sectional sizes; where the stringers, deck boards, and blocks are configured to form the pallet, the deck boards being substantially parallel and spaced apart; the first stringers being substantially parallel and spaced apart and transverse to the deck boards, and transverse to the blocks; where the first dowels secure the deck boards, first stringers, and blocks together at the acute angle $\alpha$ in a predetermined orientation to form a first portion of a pallet; where the second dowels secure the second stringers and the blocks together at an acute angle $\beta$ to a vertical axis through the second stringers in a predetermined orientation to form a second portion of a pallet.

It is further an object of this invention for the first dowels to be disposed so that a part of the upper portion protrudes above the outward-facing surface of a deck board.

It is further an object of this invention that the second stringers include depressions for receiving the protruding upper portions of the first dowels of a second pallet.

It is further an object of this invention that the upper portion of the dowel includes a dome-shaped end.

It is further an object of this invention that the dome-shaped end is smooth.

It is further an object of this invention that a bottom surface of the second stringer has mouths of the bores between at least a first depression and a second depression.

It is further an object of this invention for each opening extending through the deck board at an angle $\alpha$, $\beta$ of between 8-18 degrees.

It is further an object of this invention for the aligned bores and channels to define substantially linear paths.

It is further an object of this invention that at least one of the bores of the first stringers is substantially parallel to at least one of the bores of the second stringers, and at least another bore of the first stringers is substantially parallel to another bore of the second stringers.

It is further an object of this invention that the dowels comprise at least two contiguous dowel sections having different cross-sectional sizes so that the bore has a cross sectional area to dowel cross sectional area ratio less than one in the lower portion of the dowel and the cross sectional area of the bore to dowel cross sectional area ratio is one or greater in the cross section of the openings in the upper portion of the dowel.

Another aspect of the invention relates to a pallet including: a plurality of exterior and interior blocks, the exterior blocks being spaced apart along an exterior side of the pallet, each block having upper and lower surfaces, each surface having a plurality of channels extending substantially non-perpendicularly into the block; a plurality of stringers, the stringers being spaced apart and parallel, each stringer including a plurality of bores traversing the stringer, the bores each corresponding to a channel of a corresponding block; a plurality of deck boards, each deck board including an elongated mounting surface with a plurality of openings traversing the deck board, each opening corresponding to a bore of a corresponding stringer, the deck boards being spaced and parallel, and transverse to the stringers; a plurality of protruding dowels, each dowel including first and second portions of different cross-sectional sizes, the first portion for inserting through the opening of the deck board and through the respective bore of the stringer and into the respective channel of the block such that the deck boards, stringers, and exterior blocks are joined in a predetermined orientation to form a top portion of the pallet, and the second portion for fastening to the opening of the deck board such that an end of the second portion protrudes outside the deck board; and a plurality of non-protruding dowels, each dowel including first and second portions of different cross-sectional sizes, the first portion for inserting through the bore in the stringer and into the respective channel of the block such that the deck boards, stringers, and exterior blocks are joined in a predetermined orientation to form a bottom portion of the pallet, and the second portion for fastening to the bore of the stringer such that an end of the second portion is positioned within the stringer; where the stringers on the bottom portion of the pallet include a plurality of depressions aligned to receive the ends of the protruding dowels of a second pallet.

It is further an object of this invention that the stringer includes first and second pluralities of bores positioned at first and second angles relative to a surface of the stringer that is adjacent to the block.

It is further an object of this invention that the exterior blocks comprise first and second exterior blocks, the second exterior blocks being smaller in thickness than the first exterior blocks.

It is further an object of this invention that the dowels have at least three contiguous dowel sections of successively decreasing cross-sectional sizes and the bores include at least three contiguous bore sections of successively decreasing cross-sectional diameter.

It is further an object of this invention that the protruding ends of the dowels are hemispherical.

It is further an object of this invention that the plurality of depressions comprises first and second depressions, the second depressions defining a larger negative space than the first depressions.

Another aspect of the invention relates to a pallet including: a plurality of blocks, the blocks being positioned between a plurality of upper and lower stringers, each block having upper and lower surfaces, each surface having a plurality of channels traversing through the block at an angle that is acute with respect to the overall grain of the block; the plurality of upper and lower stringers, each stringer including first and second surfaces, each stringer including a plurality of bores for aligning with the channels of the blocks, the bores set at an angle that is acute with respect to the overall grain of the block; a plurality of deck boards, each deck board including an outward-facing surface and a first plurality of openings and a second plurality of openings, each opening traversing through the deck board at an angle that is acute with respect to the overall grain of the block; and a plurality of upper and lower dowels for aligning the deck boards, stringers, and blocks into the pallet; the upper dowel for inserting into the upper surface channel of the block, the corresponding bore of the upper stringer, and the corresponding opening of the deck board; the lower dowel for inserting into the channel of the lower surface channel of the block and the corresponding bore of a lower stringer, where wherein the stringers, deck boards, and blocks are configured to form the pallet.

It is further an object of this invention that the channels of the blocks comprise a first plurality of channels disposed at a different angle relative to the overall grain of the block than a second plurality of channels.

It is further an object of this invention that the acute angles of the bores of the upper stringers are positioned at different angles relative to the acute angles of the bores of the lower stringers.

It is further an object of this invention that at least one bore of the upper stringer is substantially parallel to at least one bore of the lower stringer; and at least one other bore of the upper stringer is substantially parallel to at least one other bore of the lower stringer.

It is further an object of this invention that the bores of the upper stringer angle inward toward a central axis shared by the upper and lower stringers, and the bores of the lower stringer angle outward from the central axis shared by the upper and lower stringers.

It is further an object of this invention that each bore forms an angle between 4-60 degrees with respect to a central axis shared by the upper and lower stringers.

It is further an object of this invention that the dowels are disposed so that a base portion of the dowel protrudes above the outward-facing surface of the deck board.

It is further an object of this invention that the lower stringers include depressions configured for connecting to the protruding base portions of a second pallet and for vertically stacking the pallets together.

It is further an object of this invention that the base portion of the dowel is curved.

It is further an object of this invention that the base portion of the dowel lacks a sharp edge.

Another aspect of the invention relates to a substantially all wood half pallet including a plurality of deck boards, upper and lower stringers, and single piece blocks positioned to form a half pallet with a long side and a short side, the deck boards being parallel to one another with interior deck boards and the upper stringers being spaced and perpendicular to one another in a horizontal plane and transverse to and adjacent to an exterior or interior deck board on an upper surface and adjacent to one or more of the blocks on an opposite surface, the blocks comprising first and second blocks the second blocks being on an exterior side of the half pallet, the second blocks being smaller in thickness than the first blocks, the edges of the exterior and interior deck boards, the upper and lower stringers, and the first and second blocks being in the same vertical plane, the deck boards having a mounting surface and a top surface; the half pallet having through openings on both the long side and the short side to allow the insertion of pallet forks from the long side and short side; a plurality of upper dowel paths for receiving an upper dowel, the upper dowel paths defined by: a plurality of first openings extending completely through the deck boards, a plurality of second openings extending completely through an adjacent upper stringers, and a plurality of upper bores extending into an adjacent surface of an adjacent block, where the first openings, second openings, and upper bores extend substantially non-perpendicular to the top surface of the deck board; a plurality of upper dowels, each having a crown portion, disposed in the upper dowel path such that the crown portion protrudes above the top surface of the deck board, wherein the upper dowels connect the deck boards, upper stringers, and blocks through a cinching action on at least the deck boards; and a plurality of lower dowel paths defined by: a plurality of openings in a lower stringer, and a plurality of lower bores extending into the adjacent surface of the adjacent blocks, wherein the openings and the bores extend substantially non-perpendicular to a bottom surface of the lower stringer, the lower dowel paths each for receiving a lower dowel; where the lower stringers further include dimples, the crown portions of the upper dowels positioned for engaging the dimples of a second substantially all wood half pallet vertically oriented on top of the substantially all wood half pallet.

BRIEF DESCRIPTION OF THE DRAWINGS

The features of the present invention which are believed to be novel are set forth with particularity in the appended claims. The drawings may not be to scale. The invention can best be understood by reference to the following description taken in conjunction with the accompanying drawings.

DETAILED DESCRIPTION OF THE INVENTION

Figure 1:
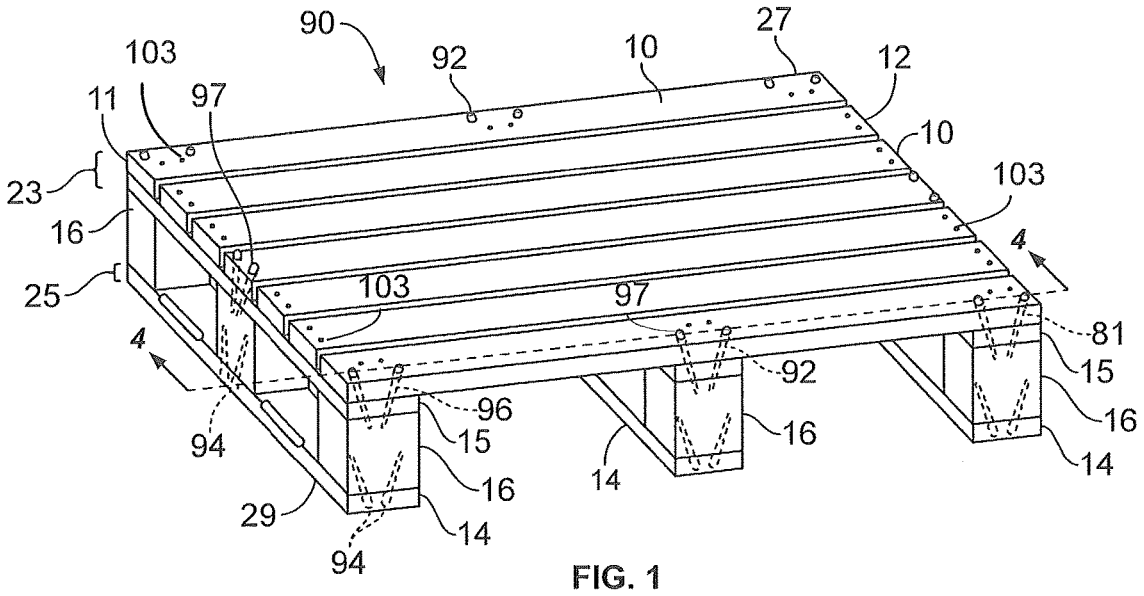
FIG. 1 is a perspective view of an embodiment of a pallet made of stringers, deck boards and dowels.
Figure 2:
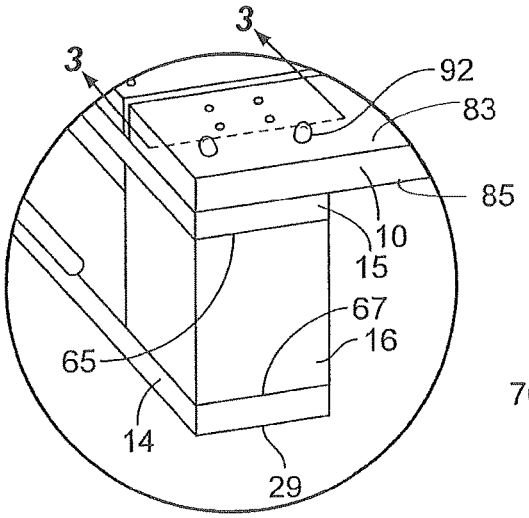
FIG. 2 is a perspective side view of a portion of the pallet of FIG. 1.

While the present invention is susceptible of embodiments of various forms, there is shown in the drawings, and will hereinafter be described some exemplary and non-limiting embodiments, with the understanding that the present disclosure is to be considered an exemplification of the invention. It is not intended to limit the invention to the specific embodiments listed.

As shown in FIGS. 1-13, a pallet or half pallet can be formed from deck boards, stringers, and blocks that are secured with dowels. Openings in the deck board, stringers, and block align to define a dowel path for the insertion of the dowel, the dowel securing the other components to each other. The dowel path and dowel can be positioned at a non-perpendicular angle in relation to the top and bottom surfaces of the deck board, stringer, and block. Improved dowels in the upper surface of the pallet can protrude to engage dimples in the bottom surface of another pallet, for aligning the pallets into a substantially vertical orientation with respect to each other.

Improved Half Pallet

In general terms, one embodiment of the invention comprises the combination of stringers, deck boards, and blocks, connected by dowels and/or adhesive, to form a pallet or half pallet.

Referring to FIGS. 1-9, a half pallet 90 can be assembled using deck boards, stringers, blocks, and dowels.

Each deck board 10 can have a first end 11 and a second end 12. The deck board 10 can comprise about a ⅝"×4"×40" board. The stringers 14, 15 can comprise about a ⅝"×4"×24" board. Between the bottom stringers 14 and upper stringers 15 are six 4"×4"×4" blocks 16 on the outside of the long or 40" side and with three 4"×4"×4" blocks 17 in the inside of the center of the short or 24" side, constituting a type of block pallet. Because this pallet can be a half pallet, the number of deck boards, stringers, blocks, and dowels can be reduced accordingly so that the pallet measures 40" by 24". Other sizes can be utilized, depending on a customer's requirements.

The deck boards 10 can have a plurality of predrilled holes or openings 81 defined therein. It is preferred that each predrilled opening 81 traverses the deck boards 10 at a non-perpendicular angle, or acute angle, with respect to the upper and lower surfaces 85 of the deck boards 10. Alternatively, the openings can traverse an angle that is acute with respect to the overall grain of the block, or with respect to a vertical axis between a top surface and a bottom surface of the block.

The lower and upper stringers 14, 15 can have a plurality of predrilled holes or bores 71 defined therein. It is preferred that the predrilled holes traverse the stringers at a non-perpendicular angle, or acute angle, with respect to the upper and lower outer surfaces of the stringers. The term "bore" or "opening" can be used interchangeably.

Blocks 16 are located at the corners and in the middle of the long sides. Blocks 17 are in the middle of the short side as well as in the overall middle of the half pallet. Blocks 16 and 17 are positioned between upper stringers 15 and lower stringers 14 so that the sides of blocks 16 and 17 are flush or even with the sides of the deck boards 10, upper stringers 15 and lower stringers 14, i.e., the edges of each are in the same plane.

The blocks 16, 17 can have a plurality of predrilled bores defined therein on their upper and lower surfaces 65, 67. It is preferred that the predrilled bores define paths or channels 61, 63 in the blocks 16, 17 at non-perpendicular angles, or acute angles, with respect to the upper and lower surfaces of the blocks 65, 67, and that the channels 61, 63 extend inward into the blocks 16, 17. At least blocks 16 and possibly blocks 17 are positioned so that the grain of the blocks is vertical. Blocks 17 can have a horizontal grain, but a vertical grain is preferred. In this manner, when an adhesive, such as glue, is applied to the holes or bores, the adhesive can migrate further into the block 16, 17 along the grain lines, for a more secure holding action. Further, each of the blocks 16, 17 can be strengthened by the vertical grain. With a vertical grain, the blocks can also be later able to withstand a hit from the fork tines, as the vertical grain will be less likely to split upon impact.

In embodiments described by FIGS. 1-9, the upper portion 23 of the pallet includes deck boards 10 and stringers 15 connected to the blocks 16, 17, and the lower portion 25 of the pallet has stringers 14, but not deck boards, connected to the blocks. Other embodiments can include modifications that include deck boards in the lower surface 29 or exclude deck boards from the upper portion 23 of the pallet.

Each deck board opening 81 can align with the corresponding bore 71 in the corresponding or adjacent upper stringer 15 and the corresponding upper channel 61 in the corresponding block 16, 17 to define an upper dowel path 91 for receiving an upper dowel 92. The bore 71 in the lower stringer 14 and lower channel 63 in the block 16, 17 can define a lower dowel path 93 for receiving a lower dowel 94. Each dowel path can be substantially linear or define a continuous path connecting the deck boards 10, stringers, and/or blocks 16, 17, forming a channel for receiving a dowel or other suitable elongated fastener. The dowel paths can secure the dowels at a non-perpendicular angle with respect to the deck boards 10, stringers 14, 15, and blocks 16, 17. Preferably, each dowel path is not perpendicular to, or is set at an acute angle to, the upper and lower surfaces 83, 85 of the deck boards 10, stringers 14,15, and/or blocks 16, 17. The upper dowel paths 91 can be substantially mirror images of each other; that is, possess substantially the same lengths and form substantially same-sized angles with respect to the surface of the half pallet, but oriented in opposite directions. Similarly, the lower dowel paths 93 can be substantially mirror images of each other; that is, possess substantially the same lengths and substantially same-sized angles, but oriented in opposite directions.

Alternatively, the dowel paths 91, 93 can traverse an angle that is acute with respect to the overall grain of the block, or with respect to a vertical axis between a top surface and a bottom surface of the block 16, or with respect to a vertical axis between the upper surface 27 of the pallet and the lower surface 29 of the pallet.

The upper stringers 15 and the lower stringers 14 are each secured to a block 16 or 17 by upper and lower dowels, 92, 94 respectively. It is preferred that the upper stringer 15 is sandwiched between the deck board 10 and the block 16, 17. When the upper dowel 92 is secured to the upper surface 27 of the pallet, part or all of a crown portion 96 of the upper dowel 92 can protrude above the upper surface 83 of the deck board 10.

As shown in FIGS. 3-9, the lower surface 29 of the lower stringer 14 can include one or more dimples 73 or depressions or indentations. When a second pallet 702 is stacked upon a first pallet 701, the upper dowels 92 of the first pallet 701 connect with or receive the dimples 73 of the second pallet 702. Similarly, when a third pallet is stacked upon the second pallet, the upper dowels 92 of the second pallet connect with or align to receive the dimples 73 of the third pallet, and so on (not shown). Thus, a plurality of pallets can be thus oriented and configured into substantially vertical alignment. These stacked or nested pallets can retain vertical orientation when the stack of pallets is struck by a fork lift, person, or other object. These pallets can retain their vertical orientation with respect to each other when moved. Such stacks pallets can have increased resistance to slippage and/or falling when subjected to vibrations.

When a second pallet 702 is stacked upon a first pallet 701, the upper surface of the first pallet 701 can be flush with the bottom surface of the second pallet 702, so that those surfaces contact each other. Alternatively, the sole points of contact between the two pallets 701, 702 can be at the locations where the upper dowels 92 of the first pallet 701 engage the dimples 73 of the second pallet 702; here, the height of the protruding portions 97 of the upper dowels 92 would be greater than the height of the negative space defined by the dimples 73.

Figure 3:
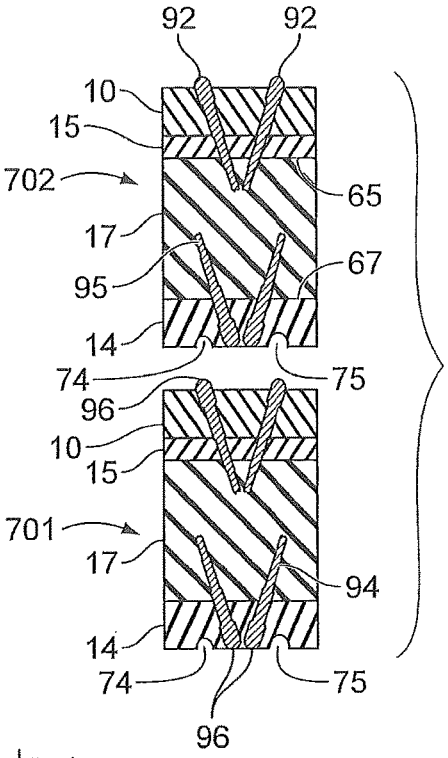
FIG. 3 is a cross-sectional view of portions of two pallets positioned for nesting.
Figure 4:
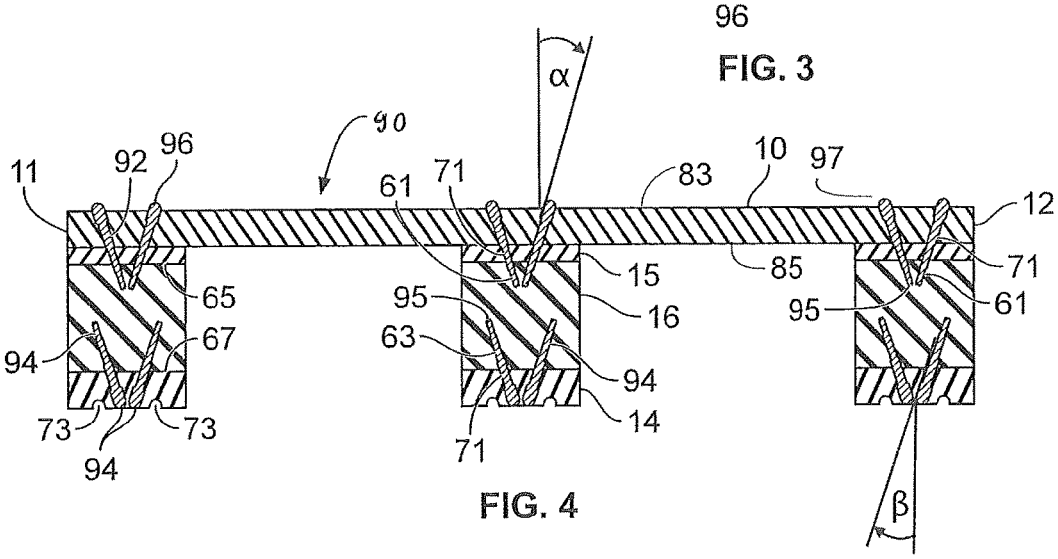
FIG. 4 is a cross-sectional view of a pallet along the line 4-4 of FIG. 1.
Figure 5:
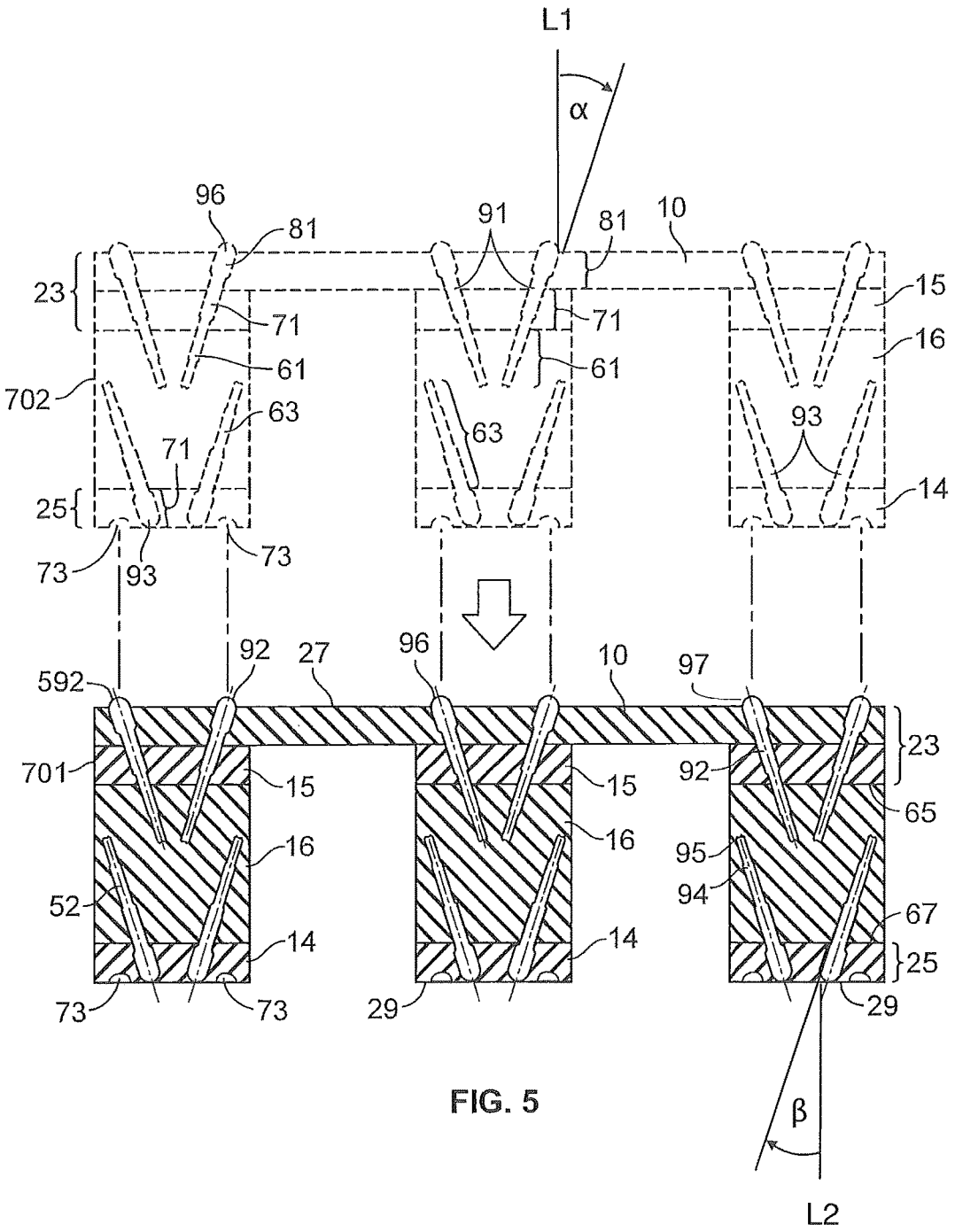
FIG. 5 shows vertical alignment of nesting pallets along the same line.
Figure 13:
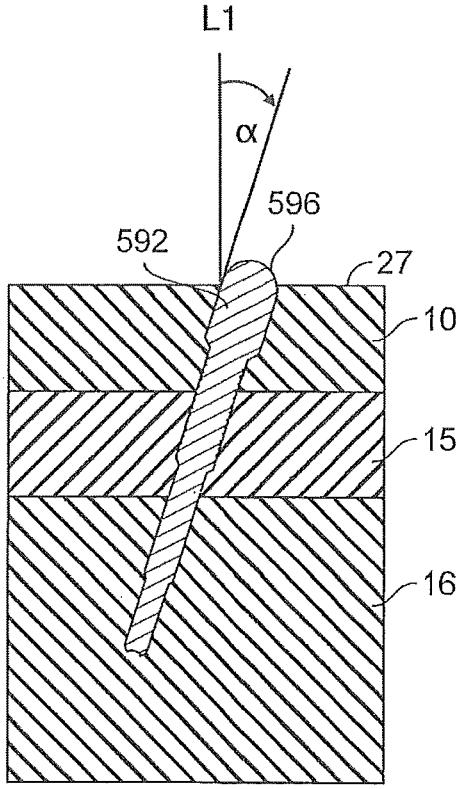
FIG. 13 is a side view of an improved dowel used to connect a deck board, stringer, and block as described in the present invention.

As shown in FIGS. 1-7, a plurality of upper dowels 92 connects the deck board 10 to the upper stringer 15 and the block 16, 17, respectively. The upper dowels 92 can be placed at an acute or non-perpendicular angle with respect to the upper surfaces 83 of the deck boards 10, upper stringers 15, and/or blocks 16, 17. As shown in the side view of FIG. 12, traditional dowels are typically positioned perpendicular to the upper surface 83 and form an angle of substantially 90 degrees, or a substantially right angle, relative to the top surface of the deck board 10, stringer 14, 15, and/or block 16, 17. As shown in FIGS. 4, 5 and 13, embodiments of the invention can include upper dowels 92 that form an acute angle $\alpha$ with a vertical axis L1 placed at an edge of the opening 81 in the upper surface 83 of the deck board 10. That angle $\alpha$ can be less than 90 degrees or between 4-80 degrees, between 6-40 degrees, or preferably between 8-18 degrees.

In some embodiments, the upper and/or lower dowels 92, 94 can be inserted into upper and/or lower dowel paths 91, 93 that form a right angle with respect to the overall grain of the block 16, or with respect to a vertical axis between a top surface and a bottom surface of the block 16, or with respect to a vertical axis between to the upper surface 27 of the pallet and the lower surface 29 of the pallet.

It is preferred that the upper dowels 92 be oriented to angle toward each other as they are inserted into the openings 81, bores 71, and upper channels 61, with the dowel tips 95 closer together than the dowel crown portions 96 when the dowels are secured. In some embodiments, as shown in FIG. 3, the dowels (in this case lower dowels 94) can be oriented to angle away from each other as they are inserted into their respective openings, bores, and channels, with the crown portions 96 closer together than the tips 95 when the dowels are secured.

Preferably, as shown in FIGS. 4, 5 and 13, the acute angle $\alpha$ described by each upper dowel 92 has substantially the same number of degrees, whether the dowels are positioned to be angled together, angled away, or parallel. Preferably, the upper dowels 92 do not meet or intersect within the deck board 10, upper stringer 15, and/or block 16, 17. Preferably, the tips 95 of the upper dowels 92 do not protrude outside of the block 16, 17.

When engaged and secured, part or the entire crown portions 96 of the upper dowels 92 can protrude above the deck board 10. The protruding portion 97 of the upper dowel 92 can be rounded or convex. While the protruding portion 97 can be smooth or textured, it is preferred that the protruding portion 97 lacks sharp edges, sharp angles, and sharp points. In some embodiments, the protruding portion 97 can describe a hemisphere or dome shape. An advantage of the general smoothness of the protruding portion 97 is for deflecting the force of impacts against the protruding portion 97, decreasing its vulnerability to damage sustained by such impacts or forces. Further, the lack of sharp edges or points decreases the likelihood of gouging or damaging a neighboring pallet when the pallets are stacked together or brush against each other, or of injuring an individual working with the pallet.

Figure 8:
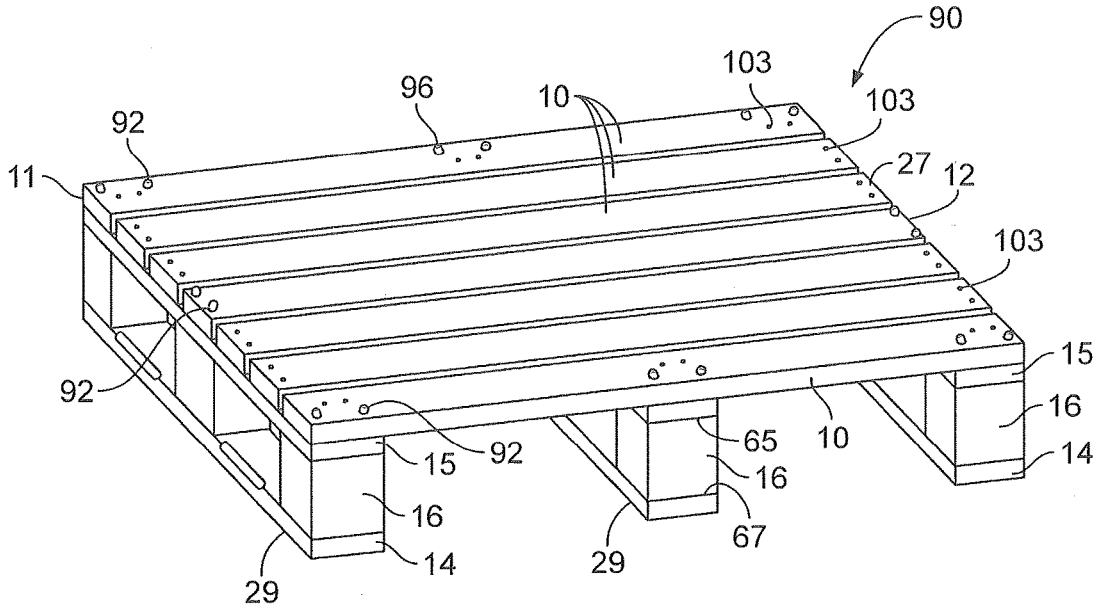
FIG. 8 is an elevated view of a pallet.

As shown in FIGS. 1 and 8, the upper dowels 92 and lower dowels 94 can be placed around the perimeter of the pallet, while fasteners 103, such as nails or staples; fasten the interior structures of the pallet. Such fasteners 103 can additionally secure or fasten the pallet together around the pallet.

In an upper dowel 92 with a hemispherical protruding portion 97, it is preferred that only the hemispherical or rounded portion, or a portion thereof, protrudes above the deck board. In some embodiments, a portion of the dowel shank 552 can also protrude above the deck board 10. It is preferred that the protruding portion 97 creates a relatively shallow profile. Such shallow profile minimizes the amount of the dowel exposed to impacts from fork lifts, other pallets, and the like.

When fastening a dowel with an angled head flush to a deck board, there is a risk that the hammer (or other tool used to secure the dowel) will strike the deck board. In this way, the deck board may sustain impact that weakens, damages, or even breaks it. Because the crown portion 96 protrudes above the upper surface 83 of the deck board 10, there is less risk of a fastening tool getting close enough to the deck boards to inflict this type of damage to the pallet. Further, this protruding feature ensures that the dowels are not inserted so far into a dowel path that the dowel is countersunk or there is a gap at the site of insertion.

Figure 6:
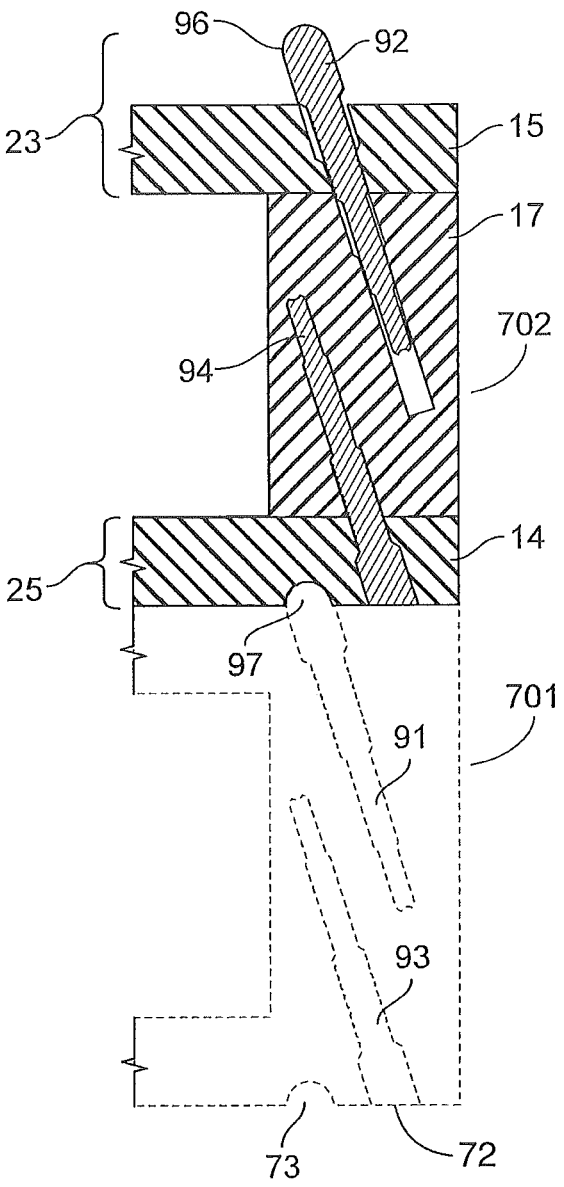
FIG. 6 shows sections of two pallets engaged together with dowels engaged.
Figure 7:
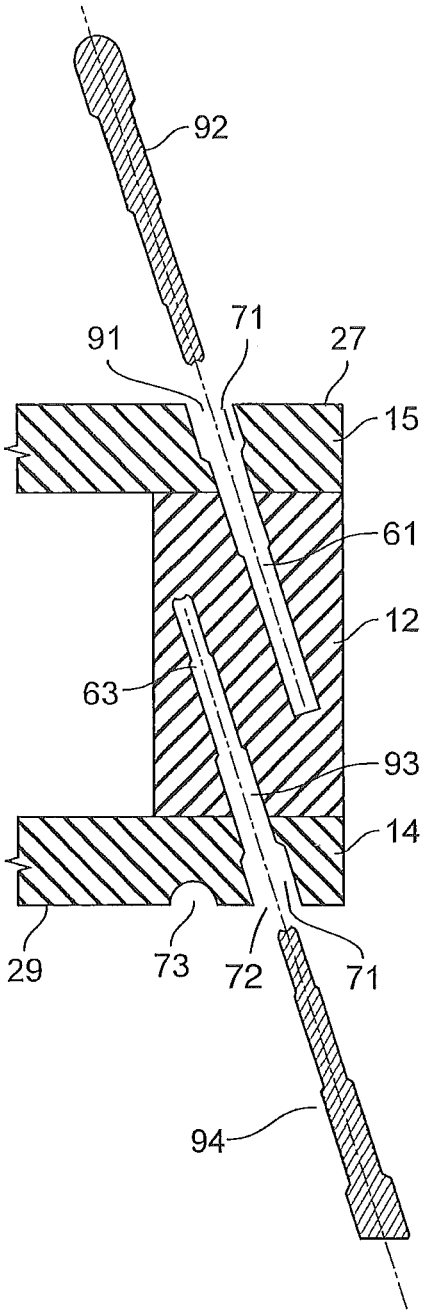
FIG. 7 shows a corresponding section of one pallet without dowels engaged.

As shown in FIGS. 5-6, in particularly preferred embodiments where a plurality of pallets are stacked atop each other, the protruding portions 97 of the upper dowels 92 of each pallet can be configured for connecting with corresponding dimples 73 of an immediately vertically adjacent pallet placed atop the pallet. The dimples 73 in the immediately vertical corresponding or adjacent lower stringers 14 are configured to receive the protruding portions 97 of the dowels of the pallet. The alignment of the corresponding protruding portions 97 and dimples 73 provides vertical alignment to stacks of pallets. When the corresponding protruding portions 97 are received by the dimples 73 of the immediately adjacent pallet, the nested pallets are physically placed into vertical alignment with each other. Users need not rely on visual cues or measuring instruments for aligning the pallets in the vertical direction.

By reliably providing vertical alignment of the pallets, this system of stacking the pallets can prevent or minimize risks created when pallets hang over the edge of a stack of pallets. Overhanging pallets can introduce extra weight or stress on lower pallets, resulting in the components near the bottom of the stack getting crushed. Further, overhanging pallets and the products they hold are known to be vulnerable to damage caused by when the stacked pallets experience vibrations. Pallets and products near the top of a stack may be especially vulnerable to vibration-induced damage and may fail entirely or fall over, resulting in additional damage to pallets, products, and passersby.

The vertical alignment generated in stacks of the improved pallets minimize or decrease the occurrence of overhang in the stacks of pallets, thus minimizing or decreasing the likelihood of damage inflicted by overhanging pallets. This vertical alignment can be further reinforced with the addition of straps, clamps, ropes, bungees, or the like, to secure the stacked pallets to each other.

The protruding portions 97 and dimples 73 can provide guidance for configuring adjacent pallets into vertical alignment. When two pallets are being stacked together, the protruding portions 97 of the lower pallet deflect the flat, non-dimpled bottom surface of the upper pallet and mate with the dimples 73 of the upper pallet, which occurs when the pallets are in vertical alignment with each other. Even where the connection between the protruding portions 97 of the dowels and their corresponding dimples 73 is loose or where the connection is incomplete, the mated structures will provide the pallets with increased resistance to sideward forces directed against the pallet, rendering stacks of such pallets more stable, more secure, and safer to use.

Further, because the crown portions 96 of the dowels and the corresponding dimples 73 are generally symmetrical, they are easier to align compared to dowels with flat or angled heads and depressions configured to receive them. The symmetry can also allow the crown portion 96 and the dowel to connect even where dowels are imperfectly aligned, minimizing the disruption of the vertical alignment of the pallets due to minor variances in the positioning of individual dowels in the pallets.

As shown in FIGS. 1, 3, 4 and 5, a plurality of lower dowels 94 connect the lower stringers 14 to the blocks 16, 17. Like the openings 81, bores 71, and upper channels 61 on the upper surface 27 of the pallet that define upper dowel paths 91, the bores 71 and lower channels 63 on the lower portion 25 of the pallet are oriented at non-perpendicular angles and aligned to define lower dowel paths 93 and form the pallet.

The lower dowels 94 can be placed into lower dowel paths 93 at non-perpendicular angles with respect to the lower surfaces 29 of the lower stringer 14, and/or blocks 16, 17 and secured. As shown in the side views of FIGS. 4-7, embodiments of the invention can include lower dowels 94 that form an acute angle β with a vertical axis L2 placed at an edge of the bore 71 in the lower surface 29 of the lower stringer 14. That acute angle β can be less than 90 degrees or between 10-80 degrees, between 5-30 degrees, or between 8-18 degrees.

The lower dowels 94 can be oriented to angle toward each other, away from each other, or substantially parallel to each. It is preferred that the lower dowels 94 can be oriented to angle away from each other as they are inserted into the openings 81 and bores 71, with the crown portion 96 (or base portion or non-tip portion) of the dowels closer together than the tips 95 when the dowels are secured. Preferably, the acute angles β described by each lower dowel 94 have substantially the same number of degrees. Preferably, the lower dowels 94 do not meet or intersect within the deck board, upper stringer 15, and/or block 16, 17. Preferably, the tips 95 of the lower dowels 94 do not protrude outside the block 16, 17.

In the lower stringers 14, it is preferred that the lower dowels 94 can be aligned so that the crown portions 96 (or base portions or non-tip portions) of the dowel do not protrude below the lower surface 29 of the lower stringer 14, so as not to interfere with the placement of the pallet on a flat surface, such as the ground or another pallet. The lower dowels 94 can have rounded crowns. In some embodiments, the lower dowels 94 can have flat or angled heads, or heads or bases with other configurations. When fully secured, the lower dowels 94 can be flush or even with the lower surface 29 of the lower stringer 14, or be completely contained within the lower stringer 14.

The mouth 72 of the bore 71 on the bottom surface 29 of the lower stringer 14, through which the lower dowel 94 is initially inserted, can be positioned at a distance away from the outer side surfaces of the block 16, 17 that is greater than the largest diameter of the lower dowels 94. In some embodiments, each mouth 72 is positioned at a distance away from both outer side surfaces of the block 16, 17 that is greater than the largest diameter of the dowel.

Figure 9:
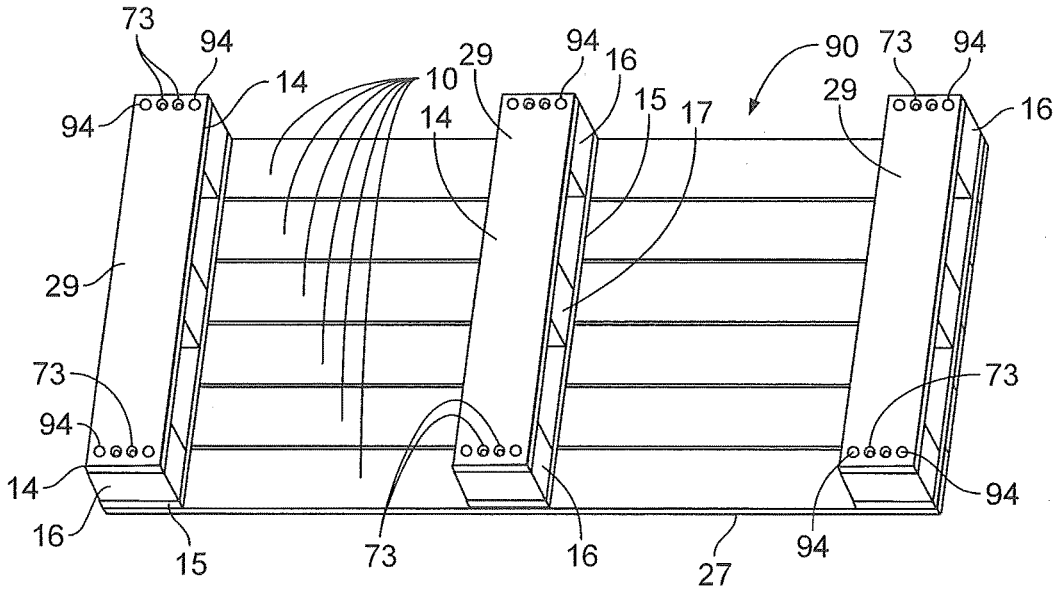
FIG. 9 shows the bottom surface of a pallet.

The bottom surface of the pallet can have dimples 73 or depressions or indentations. In embodiments disclosed in FIGS. 6-7, and as shown in FIG. 9, the bottom surface is defined by lower stringers 14, so these embodiments can include dimples 73 in the lower stringers 14. In embodiments including a deck board at the bottom surface, the deck board can include dimples 73.

The dimples 73, which can be of a size to accept the protruding portion of an upper dowel 92, can be located between the mouth 72 of the bore 71 in the lower stringer 14 and the outer side surface of the lower stringer 14. It is preferred that the dimples 73 not be located between the mouths 72 in the lower stringers 14.

The dimples 73 can be the same size or different sizes. Where the dimples 73 have different sizes, as shown in FIG. 3, the larger dimple 75 can be easier to initially align to its corresponding protruding dowel than a smaller dimple 74. Once the larger dimple 75 is mated to its corresponding protruding portion 97, it can provide a pivot point for guiding the remaining protruding portions 97 to contact their corresponding dimples 73. In some embodiments, the smaller dimple 74 can provide a tighter connection with its corresponding protruding portion 97 than the larger dimple 75 with its corresponding protruding portion 97.

The fit between a dimple 73 and a crown portion 96 can be tight, creating a secure fastening between the pallets. Alternately, the fit can create a loose connection between the pallets, so that the pallets are oriented together, but not affixed to each other. Also, where the dimples 73 are of different sizes, the fits between the dimples 73 and protruding portions 97 can be different, relative to each other.

As shown in FIGS. 1 and 3-5, the upper dowels 92 can be oriented to angle toward each other, while the lower dowels 94 can be oriented to angle away from each other. In this configuration, each upper dowel 92 is oriented substantially parallel to a lower dowel 94.

In some embodiments, the same dowels can be used as upper and lower dowels. Alternatively, the dowels can have different lengths and/or thicknesses. For example, as shown in FIG. 4, dowels having a first length can be desired for connecting a deck board, a stringer, and a block, and dowels having a second length can be used for connecting only a stringer and a block.

As shown in FIGS. 1-5, the upper dowel 92 can connect the upper stringer 15 to the deck board 10 and the upper channels 61 of the block 16. The upper dowel 92 is inserted into the upper dowel path 91 defined by the aligned opening 81 of the deck board, bore 71 of the upper stringer 15, and upper channel 61 of the block 16, 17. The dowel path is configured to receive a shank 552 of the upper dowel 92. The upper dowel path 91 is preferably sized so that it is slightly smaller than the dowel shank portion 552 that it is configured to receive. The upper dowel 92 then fits snugly into the upper dowel path 91.

Preferably, the upper dowels 92 and the upper dowel path 91 form a friction fit. This receipt of the upper dowel shank 552 in a cinching fashion is achieved by making the hole of the stringers 14, 15 have a smaller cross section area in the stringer. Thus, the hole in the upper stringer 15 cinches or grabs the upper dowel portion 552. While the hole in the upper stringer 15 is receiving the dowel in a cinching fashion, the opening 81 in the deck board 10 is made to be the same size or larger than dowel 92 cross sectional area. This means that the upper dowel 92 fits into the hole of the upper stringer 15 in a cinching and grabbing fashion caused by the compression of the upper dowel surface by the surrounding wood on the surface of the pilot hole for a tight grip caused by the ratio of the upper dowel cross sectional area to the pilot hole cross sectional area being greater than one.

The lower dowel 94 can connect the lower stringer 14 to the lower channels 63 of the block 16, 17. The bore 71 of the lower stringer 14 is configured to receive the shank 552 of the lower dowels 94. The bore 71 of the lower stringer 14 is preferably sized so that it is slightly smaller than the dowel shank portion 552 that it is configured to receive. The lower dowel 94 then fits snugly into the bore 71 of the lower stringer 14. Preferably, the lower dowels 94 form a friction fit with the lower dowel paths 93 defined by the openings 81 in the lower stringer and the lower channels 63 in the block 16, 17, like the upper dowels 92 can form a friction fit with the upper dowel paths 91.

In a preferred embodiment, the half pallet described herein consists essentially of wood and adhesive. In the most preferred embodiment, the pallet consists of wood and adhesive. The use of wooden dowels with wooden stringers 14, 15, and deck boards 10 and blocks 16 and 17, along with adhesive, can, through construction, create a half pallet that is lightweight and yet exceeds industry requirements for static strength, stiffness, and resistance to rough handling.

The forgoing allows for the dowels to act like a nail in pulling the outer piece of wood tightly to the inner piece of wood. The dowel 92 can be substantially or fully inserted into the openings 81 of the deck boards 10 and/or stringers, and the channels 61 of the block 16, 17 through the use of a suitable pounding device (not shown), such as a hammer or mallet, or through manual strength. The dowel 92 can fit snugly into the selected openings 81 in the deck board, bores 71 in the stringer, and channels 61 in the block 16, 17; preferably, they form a friction fit. In the joinder of the stringers, deck boards 10 and blocks 16, 17, adhesive can be used. The application of adhesive material (not shown) to the stringers 14, 15 and deck boards 10 is such that some of the adhesive material is disposed in the bores 71 and/or openings 81. The adhesive material which can be a mechanical or chemical adhesive, can be applied to the surfaces of the stringers 14, 15, deck boards 10, or blocks 16, 17, or side walls of the dowels 92, 94 to strengthen or augment the connection.

The adhesive material is preferably PVA, but can be any material that would adequately connect the parts of the pallet together, such as, e.g., elastomers, hot melts, urethane, epoxy, PRF, or urethane/isocyanate. Preferably, during the construction of a pallet, the adhesive is applied to the stringers 14, 15, and deck boards 10 such that some of the adhesive is disposed in the bores 71 of the stringers and openings 81 of the deck boards prior to the insertion of the dowels 92, 94. The adhesive material can also be applied to the side walls of the dowel 92, 94. In a preferred embodiment, the adhesive applied to the dowel 92, 94 is thinned to allow for more ready insertion and connection. As the dowel is inserted into the bore 71 or opening 81, the adhesive material can be at least partly scraped from the side walls to accumulate on the end wall and step walls. When a standard dowel is used, then the opening of both the stringer and the block is sized to be slightly smaller than the dowel in diameter so that the cinching action takes place.

Wood is generally a porous and fibrous material that contains numerous long channels. In living trees, these channels allow the movement of water and nutrients through those structures. in harvested wood, liquid adhesives can migrate through the same channels, creating a more secure holding than the mere adhesion of one wooden surface to another. When embodiments of the pallet include deck boards, stringers, blocks, and/or dowels constructed of wood, particularly when oriented in a vertical grain, those embodiments can enjoy additional benefits.

The non-perpendicular angles, or diagonally oriented angles, of the holes in the deck boards and stringers and the channels in the blocks facilitate increased migration of liquid adhesives into the wood grain, when compared to holes and bores that are oriented perpendicular to the surface of the deck board, stringer, and/or block.

Vertically-oriented holes or bores 71 or channels 61 are centered over a minimal cross-section of the deck board, stringer, or block. Non-perpendicularly-oriented holes or bores create a larger horizontal footprint through which an adhesive can travel, compared to vertically-oriented holes or bores. This can increase the penetration of the adhesive into the wood grain, and result in dowels with improved holding, and thus increase the strength of the connection provided by the dowel.

Horizontally-oriented holes or bores 71 or channels 61 shear the wood grain at a right angle. The bores 71 created in vertically-oriented wood grains, as is typical for the blocks 16, 17 used in such pallets, at the juncture where horizontal bore meets vertical wood grain, will shear the channels at a right angle and result in bores 71 with the smallest diameter possible in the individual channels. The bores 71 created where non-perpendicularly-oriented bores 71 meet vertical wood grain will shear the same channels with transverse cuts, creating larger diameters in comparison. These paths or openings having larger diameters will allow larger volumes of adhesive to penetrate the wood grain, whether propelled by force or gravity, increasing the penetration of the adhesive into the wood grain in a vertical direction.

The improved penetration of the adhesive into the deck boards, stringers, blocks, and/or dowels renders the vertical grain of those components less likely to split when subjected to impact from a fork lift, other pallet, or other force, improving the blocks' ability to withstand physical insults to a greater degree.

In some embodiments, the components of the pallet can be further secured with the use of additional adhesives or other traditional fastening means, such as nails or tacks.

Improved Dowel for Improved Half Pallet

In general terms, one embodiment of the invention comprises dowels used to connect stringers, deck boards 10 and blocks 16, 17 to form a half pallet.

Figure 10:
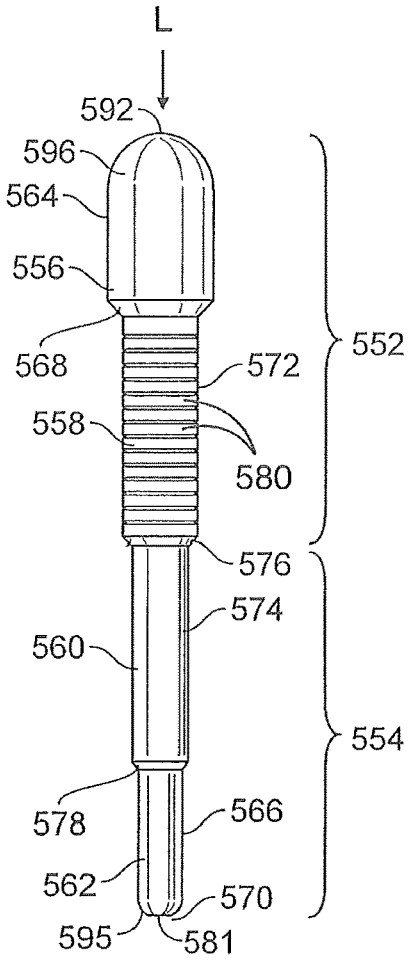
FIG. 10 is a side view of an embodiment of a dowel used in the subject invention to connect a stringer to a deck board in an embodiment of a pallet used in the subject invention.
Figure 11:
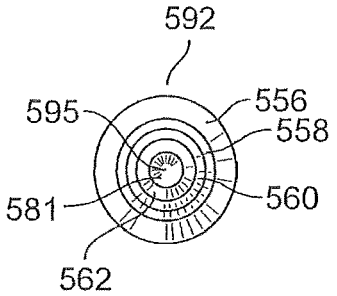
FIG. 11 is a bottom view of an improved dowel.
Figure 12:
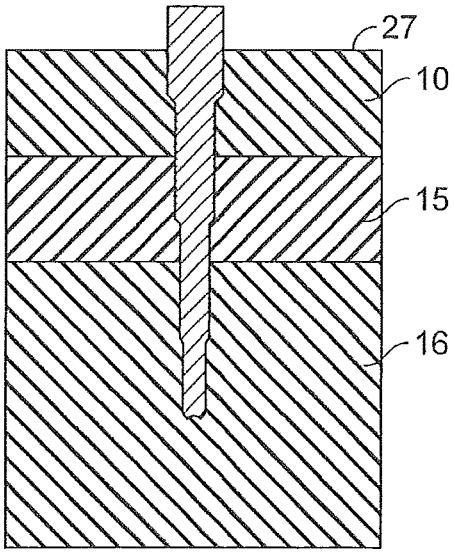
FIG. 12 is a side view of a dowel used to connect a deck board, stringer, and block (as disclosed by the prior art)

Referring to FIGS. 10-11, one embodiment of a dowel 592 can be seen. The dowel 592 can comprise a first portion 552 and a second portion 554. The dowel can have a plurality of dowel sections, a first section 556, middle sections 558, 560, and last section 562. While in a preferred embodiment, the dowel 592 can have two middle sections 558, 560; other embodiments can have no middle section, one middle section, or three or more middle sections. The first and last sections 556, 562 can have sidewalls 564, 566 and end walls 568, 570, respectively. Each of the middle sections 558, 560 can have sidewalls 572, 574 and step walls 576, 578, respectively. In a preferred embodiment, each of the sections 556, 558, 560, 562 can be contiguous to another section 556, 558, 560, 562. The sidewalls 564, 572, 574, 566 define a cross-sectional size for their respective sections 556, 558, 560, 562. In a preferred embodiment, the cross-sectional size of the sidewalls 564, 572, 574, 566 can decrease as one progresses from the first section 556 to the last section 562 in a number of steps. In such embodiments, the profile of the dowel generally tapers in a stepwise fashion. The dowel can include a shank comprising the first and second sections 556, 558 of the dowel.

The cross-sectional size of the sidewalls 564, 572, 574, 566 can be any suitable size. The length of each individual dowel section 556, 558, 560, 562 can vary considerably, and the ratios of the lengths of the dowel sections 556, 558, 560, 562 can also vary considerably. In one embodiment, the dowel section 556, 558, 560, 562 with the smallest cross-sectional size can be as long as or longer than the length of any of the other dowel sections. The dowel 592 can have some sections, e.g., 558, 560 or all sections 556, 558, 560, 562 that have ribs or grooves 580. Where multiple sections have grooves, the grooves can be the same distance apart or different distances apart. In a preferred embodiment, the second section 558 contains ribs and grooves 580.

The overall length of the dowel can be any suitable length for fastening particular components or particular combinations of components. For example, the length of a dowel that connects a deck board, stringer, and block, can have a greater length than a dowel that connects only a stringer and a block.

In a preferred embodiment, each of the sections can be contiguous to another section. Where two sections meet, there can be an end wall between them. The end wall can have a surface that is substantially perpendicular to a longitudinal axis L of the dowel. The end wall can have a surface that forms an obtuse angle with the sidewall of a neighboring section. The surface of the end wall can be smooth, textured, or grooved.

The first section can include a crown portion 596, also called a base portion or a head portion. The crown portion 596 can be textured; in preferred embodiments, such as shown in FIG. 10, the base surface is smooth. In more preferred embodiments, the base surface can describe a hemisphere. In other embodiments, the base surface can be oblong or other rounded or convex shape. It is preferred that the base surface lacks sharp edges, points, or protrusions.

The last section can further comprise a tip 595. The tip 595 can be flat or pointed, textured or smooth. The tip 595 can include a depression 581, or be slightly cupped, which can capture a quantity of adhesive when the dowel is positioned in a receiving dowel path in the wooden pallet.

As shown in FIG. 10, a step portion 576, 578 can be formed at up to a ninety degree angle with respect to the longitudinal axis of the dowel. However, the step portion can be configured in a variety of different ways; for example, the step portion can be beveled (as shown in FIG. 10), textured, or convex in shape. In other embodiments, the step portion can be recessed or concave in shape, rounded, or any other shape that will provide for proper operation of dowel when used in a particular application.

As shown in FIG. 11, an embodiment is depicted having dowel sections with a circular configuration. Other embodiments can be constructed so that each dowel section has a substantially square, triangular, or other cross-section. Further embodiments can mix and match different types of sections.

It is preferred that the dowels be constructed of similar, or even the same, materials as the deck boards and/or the stringers, such as wood. It is preferred that the dowel be constructed from a single integral piece of wood or other material. The dowel can be constructed of different pieces of wood that are functionally attached to form the dowel. Such wooden dowel is preferably made substantially of birch, but can also be made of red oak, cherry, ash, beech, or other suitable preferably hardwoods. The dowel can also be made of other materials suitable for use in wooden pallets.

In a preferred embodiment, the half pallet described herein consists essentially of wood and adhesive. In the most preferred embodiment, the pallet consists of wood and adhesive. The use of wooden dowels 92, 94 with wooden stringers 14, 15, and deck boards 10 and blocks 16 and 17, along with adhesive, can, through construction, create a half pallet that is lightweight and yet exceeds industry requirements for static strength, stiffness, and resistance to rough handling.

What is claimed is:

1. A pallet comprising:

a plurality of deck boards, each deck board including an outward-facing surface and a plurality of openings, each opening defining a hole extending through the deck board at an acute angle to the outward-facing surface;

a plurality of stringers, each stringer including first and second surfaces and a plurality of bores in between the surfaces, each bore for aligning with an opening of the deck board and set in the stringer at an acute angle to the first surface;

a plurality of first and second blocks each having first and second surfaces, each first and second surface having a plurality of channels, the channels for aligning with a bore of the stringer; and a plurality of first and second dowels, the dowels having upper and lower portions of decreasing cross sectional sizes;

wherein the stringers, deck boards, and blocks are configured to form the pallet, the deck boards being substantially parallel and spaced apart; the stringers being substantially parallel and spaced apart and transverse to the deck boards, and transverse to the blocks;

wherein the first dowels secure the deck boards, stringers, and blocks together in a predetermined orientation to form a first portion of a pallet and have an upper portion of the dowel protruding above the outward-facing surface of the deck board;

wherein the second dowels secure the stringers and the blocks together in a predetermined orientation to form a second portion of a pallet;

wherein the bores in the stringers include first and second bores disposed at different acute angles with respect to each other.

2. The pallet of claim 1 wherein the second stringers include depressions for receiving the protruding upper portions of the first dowels of a second pallet.

3. The pallet of claim 1 wherein the upper portion of the dowel includes a dome-shaped end.

4. The pallet of claim 3 wherein the dome-shaped end is smooth.

5. The pallet of claim 1, a bottom surface of the second stringer having the bores between at least a first depression and a second depression.

6. The pallet of claim 1, each opening extending through the deck board at an angle between 8-18 degrees.

7. The pallet of claim 1 wherein the aligned bores and channels define substantially linear paths.

8. The pallet of claim 1 wherein at least one of the bores of the first stringers is substantially parallel to at least one of the bores of the second stringers, and at least another bore of the first stringers is substantially parallel to another bore of the second stringers.

9. The pallet of claim 1, the dowels comprising at least two contiguous dowel sections having different cross-sectional sizes so that the bore has a cross sectional area to dowel cross sectional area ratio less than one in the lower portion of the dowel and the cross sectional area of the bore to dowel cross sectional area ratio is one or greater in the cross section of the openings in the upper portion of the dowel.

10. A pallet comprising:

a plurality of exterior and interior blocks, the exterior blocks being spaced apart along an exterior side of the pallet, each block having upper and lower surfaces, each surface having a plurality of channels extending into the block;

a plurality of stringers, the stringers being spaced apart and parallel, each stringer including a plurality of bores traversing the stringer, the bore corresponding to a channel of a corresponding block;

a plurality of deck boards, each deck board including an elongated mounting surface with a plurality of openings traversing the deck board, each opening corresponding to the bore of a corresponding stringer, the deck boards being spaced and parallel, and transverse to the stringers;

a plurality of first dowels, said first dowels having ends protruding above the mounting surface of a deck board, each dowel including first and second portions of different cross-sectional sizes, the first portion for inserting through the opening of the deck board and through the respective bore of the stringer and into the respective channel of the block such that the deck boards, stringers, and exterior blocks are joined in a predetermined orientation to form a top portion of the pallet, and the second portion for fastening to the opening of the deck board such that an end of the second portion protrudes outside the deck board; and a plurality of second dowels, each second dowel including first and second portions of different cross-sectional sizes, the first portion for inserting through the bore in the stringer and into the respective channel of the block such that the deck boards, stringers, and exterior blocks are joined in a predetermined orientation to form a bottom portion of the pallet, and the second portion for fastening to the bore of the stringer such that an end of the second portion is positioned within the stringer;

wherein the stringers on the bottom portion of the pallet include a plurality of depressions aligned to receive the ends of the first dowels of a second pallet.

11. The pallet of claim 10 wherein the stringer includes first and second pluralities of bores positioned at first and second angles relative to a surface of the stringer that is adjacent to the block.

12. The pallet of claim 11 wherein the exterior blocks comprise first and second exterior blocks, the second exterior blocks being smaller in thickness than the first exterior blocks.

13. The pallet of claim 10 wherein the dowels have at least three contiguous dowel sections of successively decreasing cross-sectional sizes and the bores include at least three contiguous bore sections of successively decreasing cross-sectional diameter.

14. The pallet of claim 10 wherein the protruding ends of the dowels are hemispherical.

15. The pallet of claim 10 wherein the plurality of depressions comprises first and second depressions, the second depressions defining a larger negative space than the first depressions.

16. A pallet comprising:

a plurality of blocks, the blocks being positioned between a plurality of upper and lower stringers, each block having upper and lower surfaces, each surface having a plurality of channels traversing through the block;

the plurality of upper and lower stringers, each stringer including first and second surfaces, each stringer including a plurality of bores for aligning with the channels of the blocks;

a plurality of deck boards, each deck board including an outward-facing surface and a first plurality of openings and a second plurality of openings, each opening traversing through the deck board; and a plurality of upper and lower dowels for aligning the deck boards, stringers, and blocks into the pallet; the upper dowel for inserting into the upper surface channel of the block, the corresponding bore of the upper stringer, and the corresponding opening of the deck board said upper dowel having a top portion that protrudes above the outward-facing surface of the deck board; the lower dowel for inserting into the channel of the lower surface channel of the block and the corresponding bore of a lower stringer;

wherein the stringers, deck boards, and blocks are configured to form the pallet.

17. The pallet of claim 16 wherein the channels of the blocks comprise a first plurality of channels disposed at a different angle relative to an overall grain of the block than a second plurality of channels.

18. The pallet of claim 16 wherein the angles of the bores of the upper stringers are positioned at different angles relative to the angles of the bores of the lower stringers.

19. The pallet of claim 16 wherein:

at least one bore of the upper stringer is substantially parallel to at least one bore of the lower stringer; and at least one other bore of the upper stringer is substantially parallel to at least one other bore of the lower stringer.

20. The pallet of claim 16 wherein:

the bores of the upper stringer angle inward toward a central axis shared by the upper and lower stringers; and the bores of the lower stringer angle outward from the central axis shared by the upper and lower stringers.

21. The pallet of claim 16 wherein each bore forms an angle between 4-60 degrees with respect to a central axis shared by the upper and lower stringers.

22. The pallet of claim 16 wherein the lower stringers include depressions configured for connecting to the protruding base portions of a second pallet and for vertically stacking the pallets together.

23. The pallet of claim 16 wherein the base portion of the dowel is curved.

24. The pallet of claim 16 wherein the base portion of the dowel lacks a sharp edge.

25. A pallet comprising:

a plurality of deck boards, upper and lower stringers, and single piece blocks positioned to form a pallet with a long side and a short side, the deck boards being parallel to one another with interior deck boards and the upper stringers being spaced and perpendicular to one another in a horizontal plane and transverse to and adjacent to an exterior or interior deck board on an upper surface and adjacent one or more of the blocks on an opposite surface, the blocks comprising first and second blocks the second blocks being on an exterior side of the pallet, the edges of the exterior and interior deck boards, the upper and lower stringers, and the first and second blocks being in the same vertical plane, the deck boards having a mounting surface and a top surface; the pallet having through openings on both the long side and the short side to allow the insertion of pallet forks from the long side and short side;

a plurality of upper dowel paths for receiving an upper dowel defined by:

a plurality of first openings extending completely through the deck boards, a plurality of second openings extending completely through the respective upper stringers, and a plurality of upper bores extending into an adjacent surface of an adjacent block, a plurality of upper dowels having a crown portion disposed in the upper dowel path such that the crown portion protrudes above the top surface of the deck board, wherein the upper dowels connect the deck boards, upper stringers, and blocks through a cinching action on at least the deck boards; and a plurality of lower dowel paths defined by:

a plurality of openings in a lower stringer, and a plurality of lower bores extending into the adjacent surface of the adjacent blocks, wherein the openings and the bores extend to a bottom surface of the lower stringer, and the lower dowel paths for receiving a lower dowel.

26. The pallet of claim 25, wherein the pallet is a half pallet.

* * * * *